United States Patent [19]

Morel et al.

[11] 4,210,514

[45] Jul. 1, 1980

[54] PROCESS FOR REDUCING THE MAGNETIC DISTURBANCES IN SERIES OF HIGH-INTENSITY ELECTROLYSIS TANKS

[75] Inventors: Paul Morel, Le Vestinet; Jean-Pierre Dugois, Ste. Jean de-Maurienne, both of France

[73] Assignee: Aluminum Pechiney, Lyons, France

[21] Appl. No.: 6,674

[22] Filed: Jan. 26, 1979

[30] Foreign Application Priority Data

Feb. 8, 1978 [FR] France ..... 78 04193

[51] Int. Cl.[2] ..... C25C 3/06; C25C 3/08

[52] U.S. Cl. ..... 204/243 M; 204/243 R

[58] Field of Search ..... 204/243 M, 243 R, 242, 204/244, 245

[56] References Cited

U.S. PATENT DOCUMENTS

| | | | |
|---|---|---|---|
| 3,736,244 | 5/1973 | Bohner et al. | 204/243 M X |
| 3,969,213 | 7/1976 | Yamamoto et al. | 204/243 M X |
| 4,072,597 | 2/1978 | Morel et al. | 204/243 M |
| 4,090,930 | 5/1978 | Morel et al. | 204/243 M X |
| 4,132,621 | 1/1979 | Morel et al. | 204/243 M |

*Primary Examiner*—Arthur C. Prescott

*Attorney, Agent, or Firm*—McDougall, Hersh & Scott

[57] ABSTRACT

The invention concerns a process for reducing magnetic disturbances in series of electrolysis tanks operating at high current strength.

The process comprises passing the negative connecting conductors between the tanks and fixing the distribution of current between the downstream end and the upstream end or the central riser input members of each tank, so as to nullify the component By of the magnetic field at the center of the tank and to render anti-symmetric the component By of the magnetic field at the middle of the long side of the tank, relative to the axis Oy. The field of the adjacent row is also compensated by means of a compensation conductor through which passes a current which circulates in the opposite direction to the electrolysis current.

Use for the production of aluminium in series of electrolysis tanks which are supplied with current strengths which may reach 200,000 amperes.

5 Claims, 15 Drawing Figures

PROCESS FOR REDUCING THE MAGNETIC DISTURBANCES IN SERIES OF HIGH-INTENSITY ELECTROLYSIS TANKS

SUBJECT OF THE INVENTION

The present invention concerns a novel process for reducing the magnetic disturbances in series of electrolysis tanks disposed in a lengthwise arrangement, operating at high current strength, which are intended for the production of aluminium by electrolysis of alumina dissolved in molten cryolite. The invention is used for reducing the disturbances due to the actual field produced by each tank and by the neighbouring tanks in the same row and in the adjacent row when the latter is at a relatively small distance from the first-mentioned row.

It is known that, in order to reduce investment costs and to increase output, there is a tendency to increase the power of the tanks which, being operated at a current of 100,000 amperes 20 years ago, are now operated at 200,000 amperes. It is also known that tanks which are disposed transversely with respect to the axis of the row produce smaller magnetic effects than tanks which are disposed lengthwise, with the dimensions being equal, in spite of the complication in the conditions of operation and the deterioration in the operating conditions which result therefrom. From this point of view, tanks which are disposed lengthwise do not suffer from these disadvantages, and the aim of the invention is a process which makes it possible to reduce the magnetic effects of lengthwise tanks, to a lower level than that of transversely disposed tanks, hence providing substantial energy savings, while maintaining the operating advantages which are achieved with a lengthwise arrangement.

In the following specification, in accordance with the usual conventions, $B_x$ $B_y$ and $B_z$ will denote the components of the magnetic field along axes Ox,Oy and Oz, in a straight right-angled trihedron whose centre O is the centre of the cathodic plane of the tank, Ox is the longitudinal axis in the direction of the row, Oy is the transverse axis and Oz is the upwardly directed vertical axis.

In accordance with the usual convention, the positions upstream and downstream will be denoted by reference to the conventional direction of the current in the series.

Figure 1:
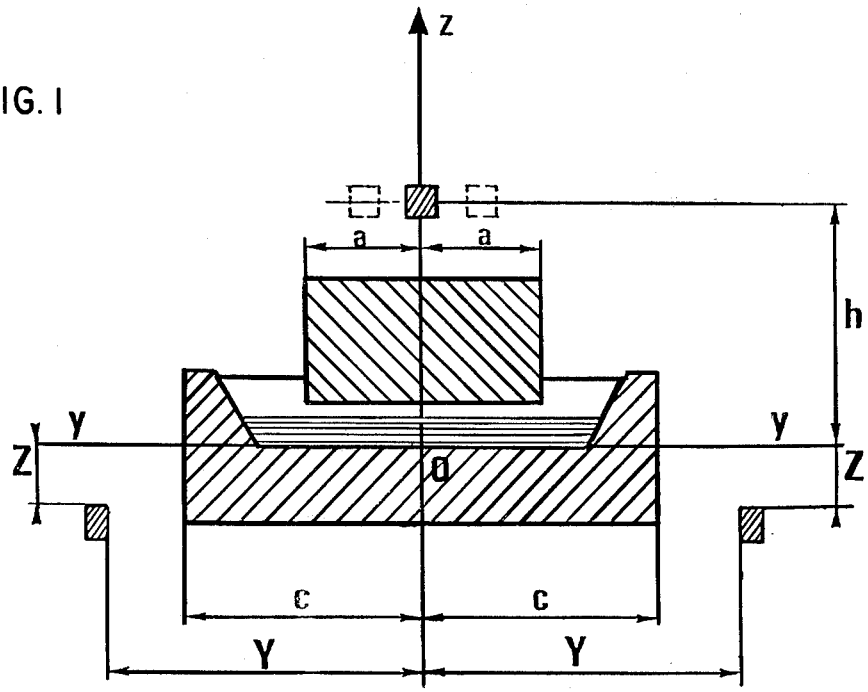
Figure 2:
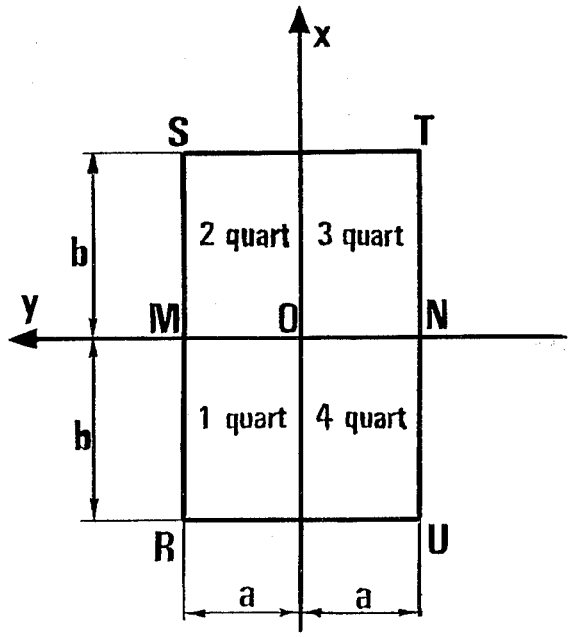
Figure 3:
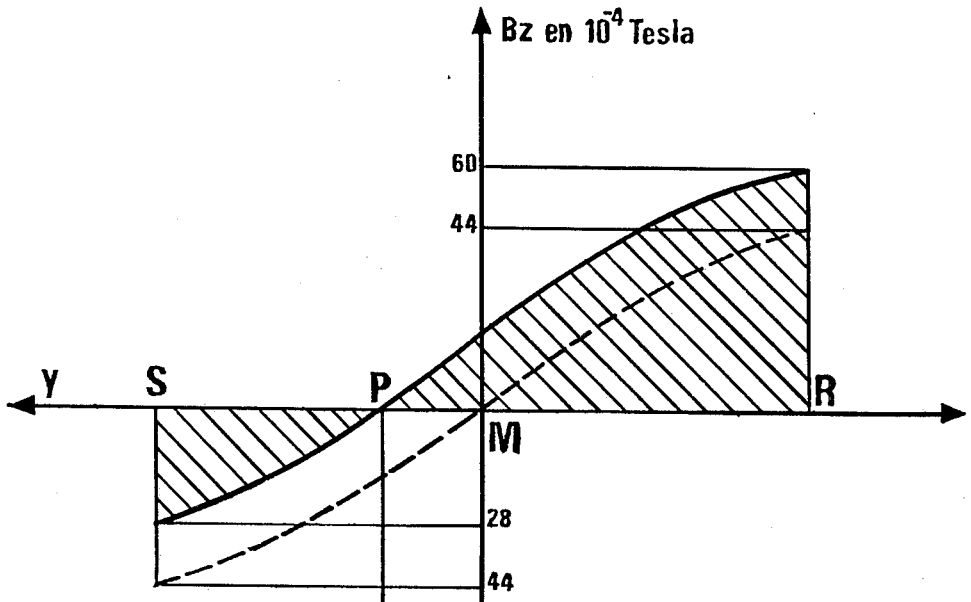
Figure 4:
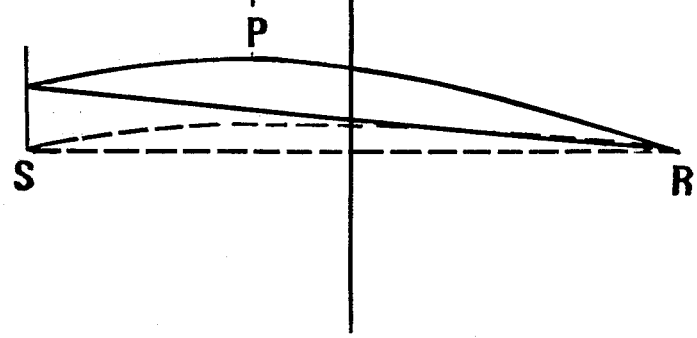
Figure 5:
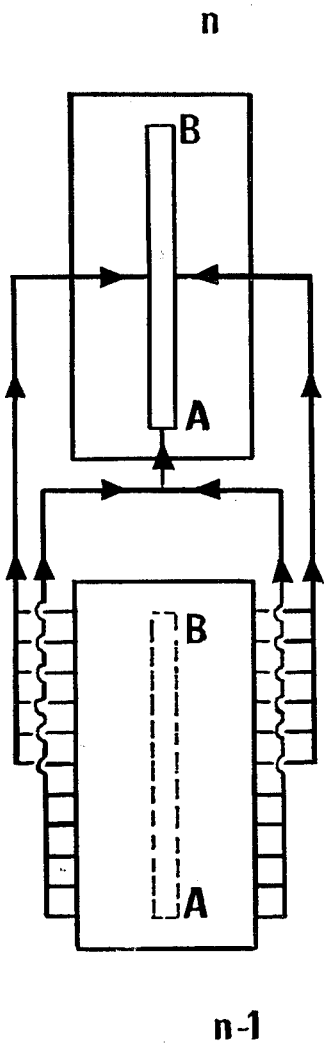
Figure 6:
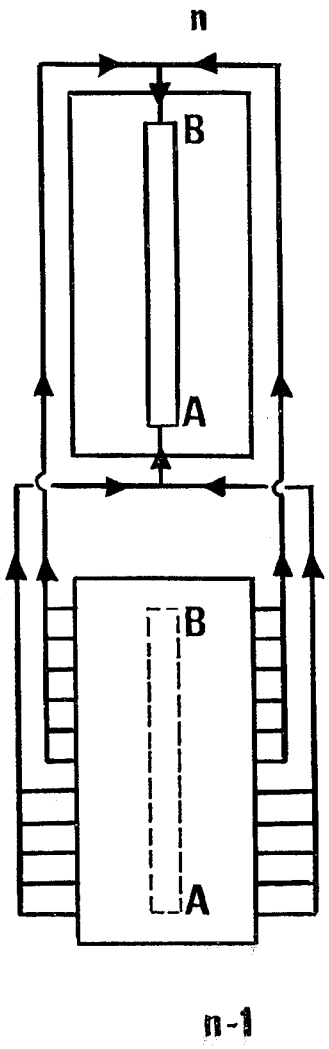
Figure 9:
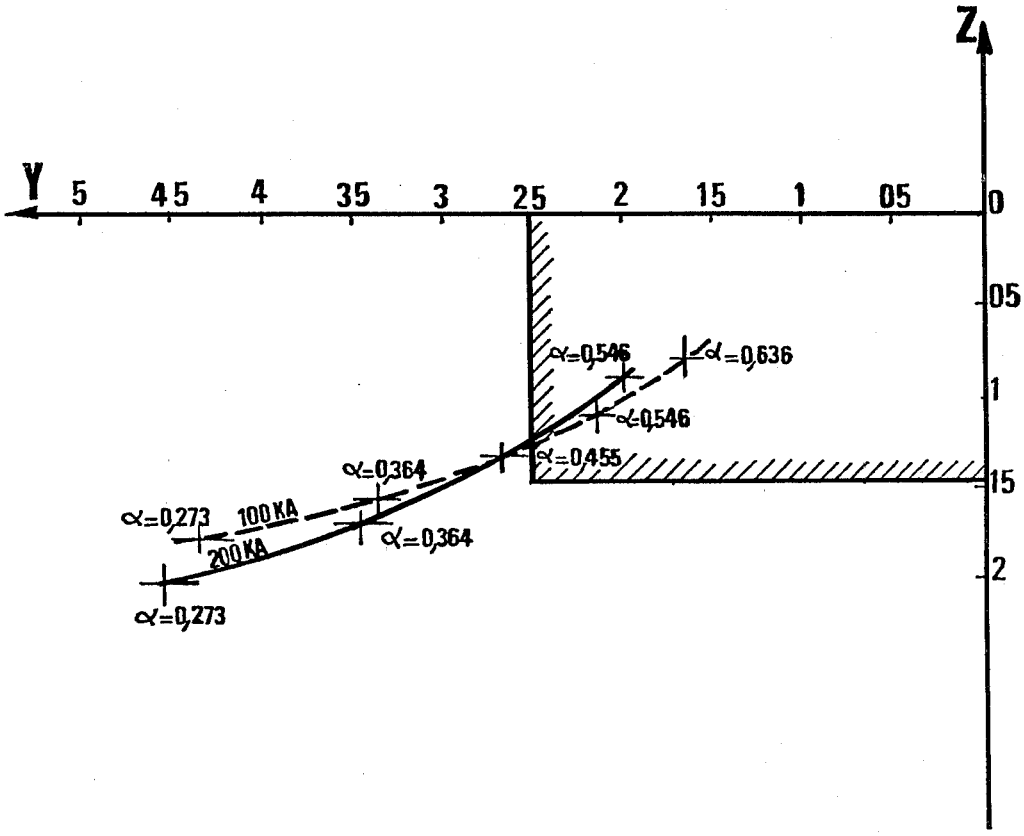
Figure 10:
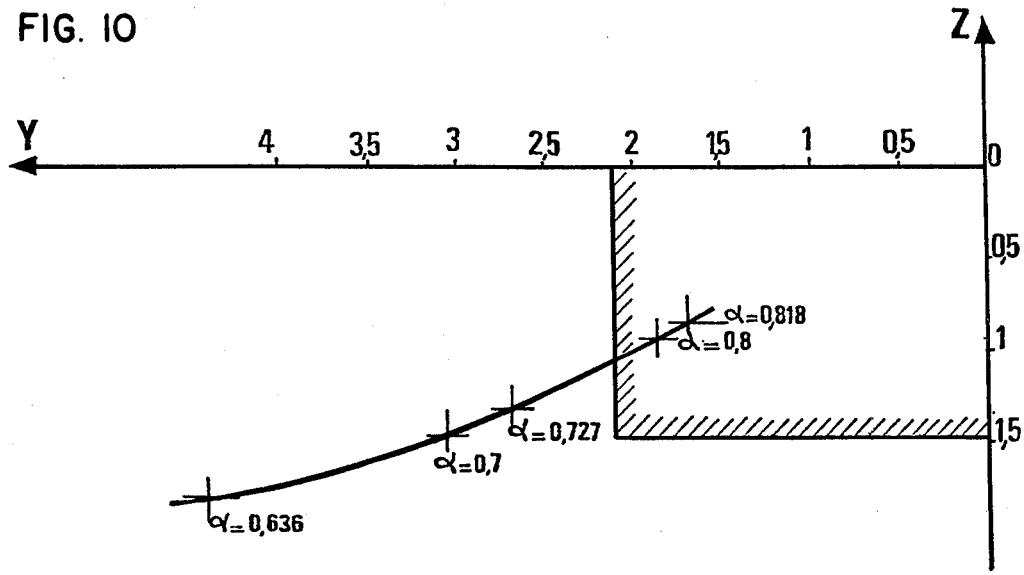
Figure 11:
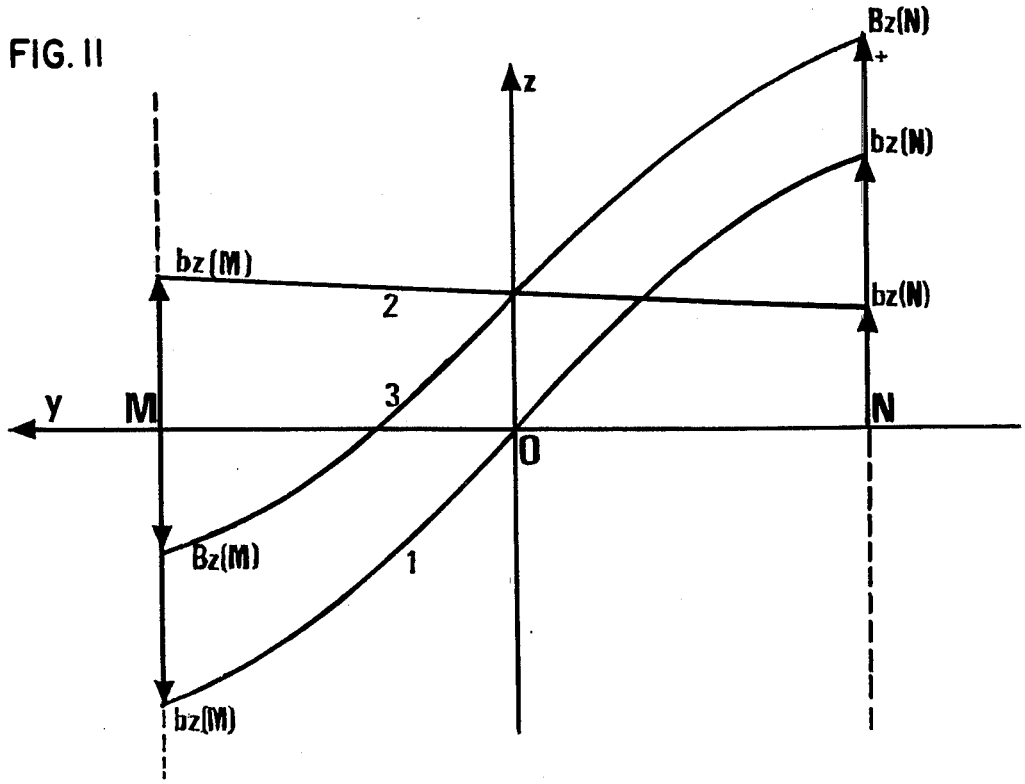
Figure 12:
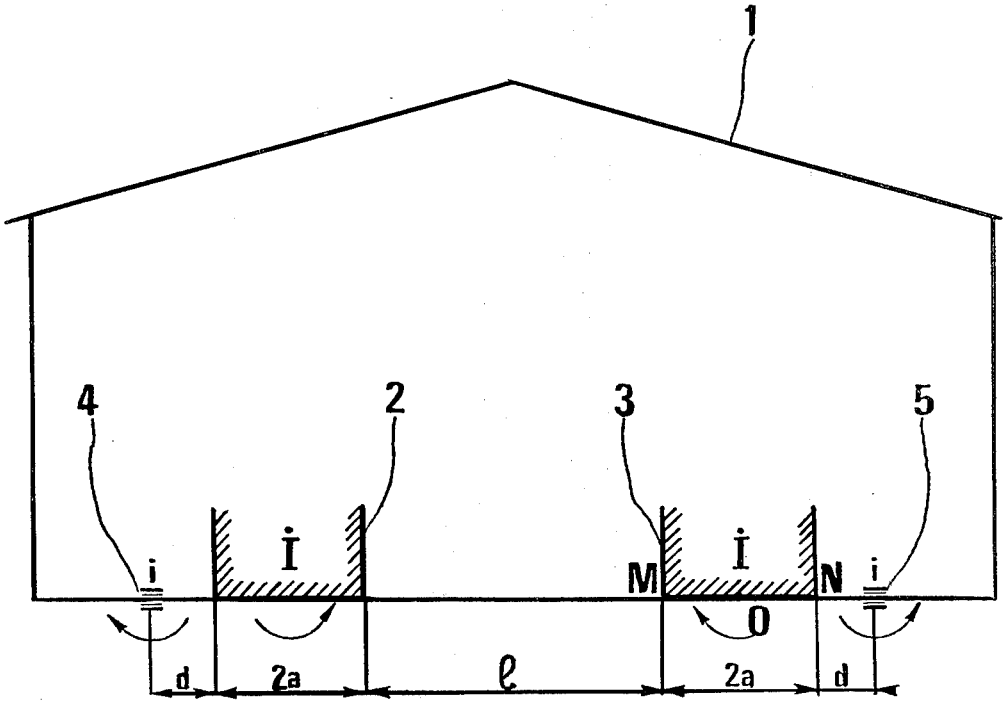
Figure 13:
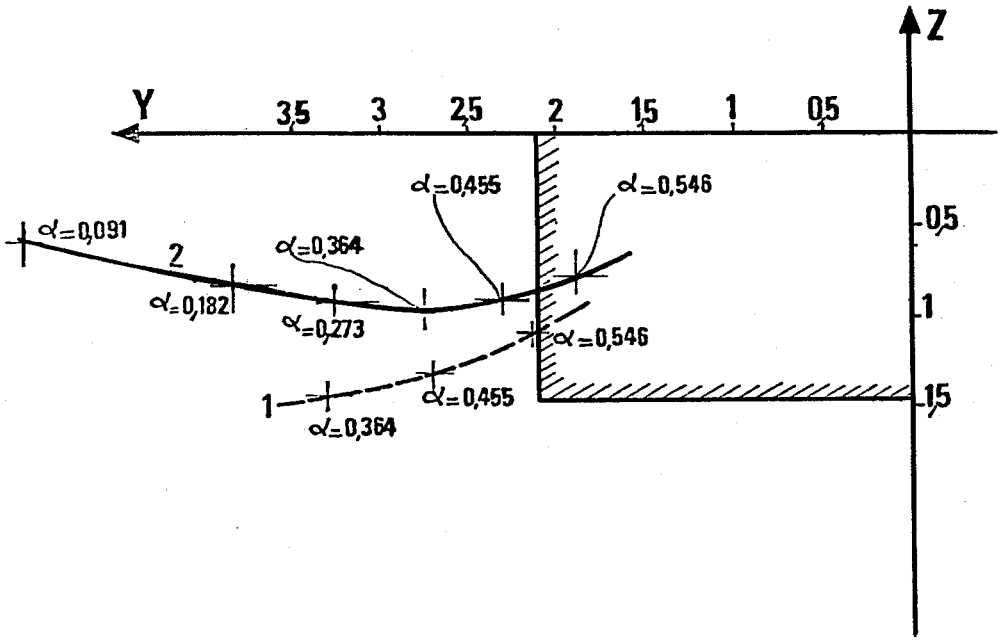
Figure 14:
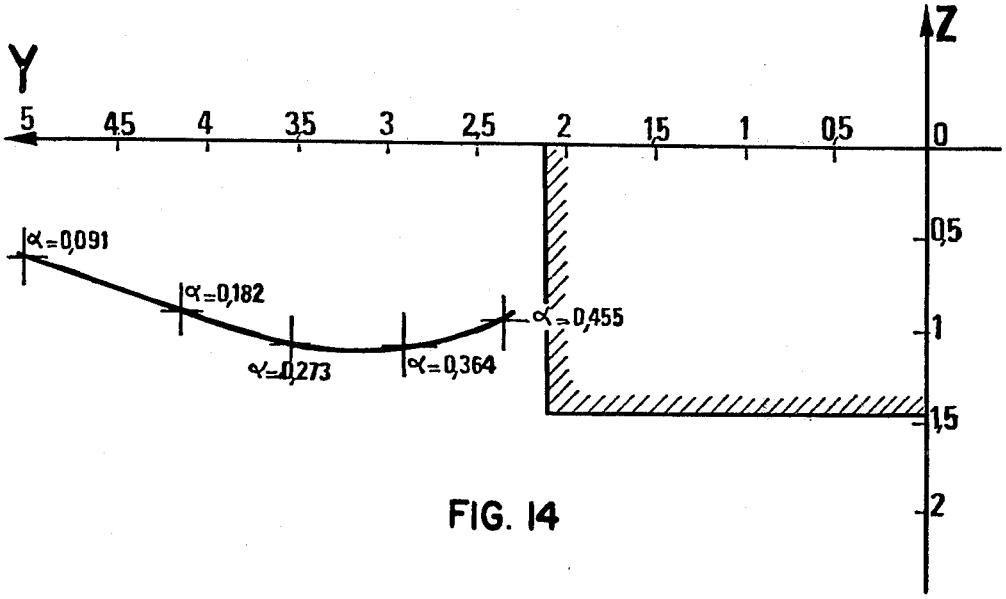
Figure 15:
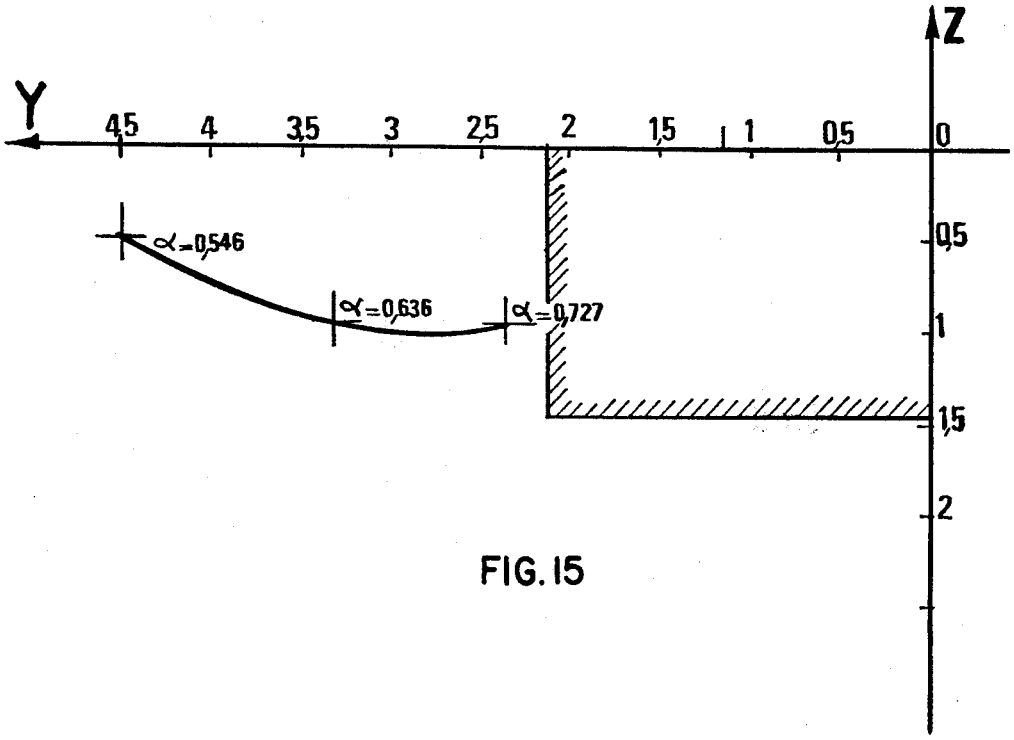

FIG. 1 shows a view in vertical transverse section through point O of a lengthwise disposed electrolysis tank, FIG. 2 shows a diagrammatic view in horizontal section through the point O of a lengthwise disposed electrolysis tank, FIG. 3 is a diagram of the field $B_z$ along a long side of the tank, FIG. 4 shows the shape of the metal-electrolyte interface, in accordance with the distribution of the field $B_z$ in FIG. 3, FIGS. 5 and 6 diagrammatically show two possible arrangements for supplying the lengthwise disposed tanks; by way of one end and central input riser members (FIG. 5) or by way of the two ends (FIG. 6), FIGS. 7, 8, 9 and 10 show the position of the negative conductor according to the invention, in dependence on the coefficient $\alpha$, being the fraction of current which feeds the upstream end, FIG. 11 illustrates the influence of the field of the adjacent row on the total field of a tank given by its small axis Oy, FIG. 12 shows the position of the conductors for compensation of the field of the adjacent row, in an electrolysis hall comprising two relatively close rows, and FIGS. 13, 14 and 15 show the position of the negative conductor in dependence on the coefficient $\alpha$, when account is taken of the influence of the adjacent row.

STATEMENT OR PROBLEM

French Pat. No. 1 143 879 filed on Feb. 28, 1956 in the name of PECHINEY set out the conditions to be observed in order to reduce the magnetic effects in lengthwise-disposed tanks, and most of the tanks built throughout the world from that time have used the arrangements of conductors as set forth, in order to satisfy the double condition:

$$\left.\begin{array}{l} B_{y^o} = 0 \\ \dfrac{dB_{y^o}}{dz} = \text{low} \end{array}\right\} \text{at the center of the tank}$$

wherein $B_{yo}$ is the horizontal component of the magnetic field along the axis Oy (horizontal axis perpendicular to the axis of the row) and $dB_{yo}/dz$ is the gradient of that potential along the vertical axis at the centre of the tank.

Reference will be made hereinafter to the diagrammatic view of an electrolysis tank, as shown in transverse section in FIG. 1.

However, the conditions set forth in French Pat. No. 1 143 879 concerned only the horizontal field and did not have any effect on the vertical field whose value is virtually proportional to the current strength passing through the tank.

Now, recent study has shown the importance of the vertical field. It is responsible in particular for a 'dome-like' deformation of the layer of liquid aluminium, the dome being asymmetric and its top being offset towards the downstream end of the tank, corresponding to a difference in level which can exceed 4 cm relative to the reference plane.

The forces, referred to as Laplace forces, which are produced in the metal are the source of the deformation of the bath-metal interface.

Forces along the axis Ox: $f(x)=j_y B_z - j_z B_y$

Forces along the axis Oy: $f(y)=j_z B_x - j_x B_z$;

$B_x$, $B_y$ and $B_z$ being the three components of the magnetic field along the axes Ox, Oy, Oz, and $j_x$, $j_y$ and $j_z$ being the three components of the current density in the metal.

Setting out the solution provided by the invention to the problem of the magnetic effects will be facilitated by analysis of the different components of such forces.

We shall first consider the horizontal section of a lengthwise tank in FIG. 2 at the position of the central point O, which is divided into four quarters by the axes Ox and Oy, and we shall first determine the longitudinal forces along the lines parallel to Ox.

The group of forces $f_1(x)$ on a line parallel to Ox (on abscissa y) in the first quarter is:

$$F_1(x) = \int_{-b}^{O} f_1(x)\,dx = j_y \int_{-b}^{O} B_z \cdot dx - j_z \int_{-b}^{O} B_y \cdot dx$$

as $j_y$ is constant by virtue of the conventional arrangement of the cathodic bars with transverse outputs; this also applies to $j_z$.

Likewise, in the second quarter:

$$F_2(x) = \int_{-O}^{+b} f_2(x)\,dx = j_y \int_{O}^{+b} B_z \cdot dx - j_z \int_{O}^{+b} B_y \cdot dx$$

If $F_1(x) = -F_2(x)$, the forces on each line parallel to Ox will be equal and opposite. For that, it is sufficient for:

$$\int_{-b}^{O} B_z \cdot dx = -\int_{O}^{+b} B_z \cdot dx$$

and for:

$$\int_{-b}^{O} B_y \cdot dx = -\int_{O}^{+b} B_y \cdot dx$$

These two conditions are met if the curves of Bz and By are anti-symmetric with respect to the axis Oy.

The case of the vertical field $B_z$: in a tank arranged lengthwise, the curve of $B_z$ on each line parallel to Ox is anti-symmetric with respect to its value at its centre point, as can be seen in FIG. 3. It is sufficient therefore to make $B_z$ zero on the axis Oy, for the whole of $B_z$ to be anti-symmetric with respect to Oy. At the centre O of the tank, $B_z$ (o) is then zero by symmetry. $B_z$ is at a maximum on the line parallel to Ox, which passes through the outside edge of the anodic system, and if $B_z$ is nullified at the point M, the curve of the maximum $B_z$ will also be anti-symmetric.

If $B_z$ (M) and $B_z$ (o) are zero, the value of $B_z$ on the axis Oy does not exceed 2 to $3.10^{-4}$ Tesla, for a tank of 100,000 amperes, which is negligible.

Therefore, the values of $B_z$ at all the points which are disposed symmetrically with respect to Oy are equal in value and of inverse sign, and the curves of $B_z$ on each line parallel to Ox will be anti-symmetric.

The case of the horizontal field $B_y$: the condition $B_y$ (at the central point O)=0 already set forth in French Pat. No. 1 143 879 is preserved. It is found that, when $B_y$ (o)=0, the values of $B_y$ on the axes parallel to Oy are at a minimum and very low. The curve of $B_y$ on each axis is then also anti-symmetric.

In total, when the two conditions $B_z$ (M) and $B_y$ (o)=0 are achieved, it can be seen that on each line parallel to Ox:

$$F_1(x) = -F_2(x)$$

and $\Sigma F_1$ (x) in the first quarter of the tank $= -\Sigma F_2$ (x) in the second quarter of the tank.

Equality of the forces results in a bath-metal interface in the form of a symmetrical dome of minimum camber.

FIG. 4 shows, in the case of a conventional 115 000 ampere tank, and corresponding to FIG. 3: in solid lines, the dissymmetric dome shape and substantial camber (up to 4 cm) in the case of a dissymmetric curve $B_z$ (solid line), and the symmetrical dome shape with a low degree of camber (about 1 cm) in the case where $B_z$ is anti-symmetric with respect to the axis Oy, that is to say, after the invention has been put into use.

In the first case, the dissymmetric force originates from the fact that the group of positive forces of R to P, $F_1$ (x) is approximately 3 times the whole of the negative forces $-F_2$ (x), from P to S.

We shall now determine the tranverse forces, along the lines parallel to Oy, with the same conventions as for F (x), we have:

$$F_1(y) = \int_{+a}^{O} j_z B_x\,dy - \int_{+a}^{O} j_x B_z\,dy$$

$$F_4(y) = \int_{O}^{-a} j_z B_x\,dy - \int_{O}^{-a} j_x B_z\,dy$$

These transverse forces are much lower than the longitudinal forces F (x) as they are applied over shorter lengths (the width of the tank).

Now:

$J_x$ in the well constructed tank is zero, and $j_z$ is constant.

In a lengthwise tank in which the conductors are usually disposed symmetrically with respect to the plane x Oz, Bx is anti-symmetric with respect to Ox. This means that:

$$F_1(y) = -F_4(y)$$

and $\Sigma F_1$ (y) on the first quarter of the tank $= -\Sigma F_4$ (y) on the fourth quarter of the tank.

We arrive at the conclusion that, if a tank is constructed in which:

$$B_y(o) \text{ and } B_z(M) = 0$$

(1) the value of the maximum fields which, for $B_z$ and $B_y$, are disposed at the periphery of the tank, is reduced;

(2) the Laplace forces will be at a minimum and equal and opposite with respect to the axes Ox and Oy; and (3) the result will be that the surface of the interface between the electrolyte and the liquid aluminium layer will be stable and virtually horizontal.

It may also be advantageous to provide for an additional condition, relative to the component $B_y$ at the centre, which is:

$$\frac{dB_{y^o}\,(\text{center})}{dz} = 0$$

Although this gradient is generally fairly low, it is possible to seek to determine the extent to which the different conditions are compatible with each other, to bring it as close as possible to zero, which in fact amounts to making $B_y$ zero throughout the thickness of the layer of liquid metal, which is small and which varies only by a few centimeters with respect to its mean level.

STATEMENT OF THE INVENTION

The problem to be overcome having thus been set, the subject of the invention is a process for carrying into effect the two conditions $B_y$ (o) and $B_z$ (M)=0 and possibly the third condition $dB_{yo}/dz=0$, characterised by a particular arrangement of the connecting conductors between the different tanks of a series in which such tanks are disposed lengthwise, also taking account of the influence of the magnetic field of an adjacent row when the two rows are disposed at a sufficiently small distance for it not to be possible to neglect such influence. The invention is applied to lengthwise tanks which are supplied either by way of the two ends or by way of the upstream end and at least one lateral riser input member on each side.

Generally, the negative conductors (conductors connecting between the tanks) are disposed symmetrically with respect to the median plane xOz. Referring to FIG. 1, references Y and Z will denote the co-ordinates of said conductors in the plane xOz.

The process is then characterised in that the negative conductors are disposed parallel to the axis Ox and pass substantially through points whose co-ordinates Y and Z which satisfy a first equation system, make it possible to carry into effect the two equations $B_y(o)=0$ and $B_z(M)=0$ or, which amounts to the same thing, $B_z(M)$ which is anti-symmetric with respect to the axis Oy; it is also characterised in that every effort is made to ensure that the co-ordinates Y and Z at least approximately satisfy a third equation, making it possible to carry into effect the additional condition $dB_{yo}/dz=0$ or at least, to approximate to such condition as far as possible, insofar as the solutions are compatible with each other.

It is finally characterised, in that, besides the above conditions, the field of the adjacent row is compensated by at least one auxiliary conductor disposed along each row in which a continuous current is circulated in the opposite direction to the direction of the current circulating in the row and whose current strength is provided by the resolution of an equation system taking account of the various magnetic influences on each tank.

We shall now successively examine the case of a series comprising two rows of tanks which are sufficiently spaced apart so as not to suffer from an effect from an adjacent row, and then the case in which an adjacent row has an effect, and in both cases, a distinction will be made between the conventional tanks which are supplied by way of the two ends and tanks which are supplied by way of the upstream end and central riser input members, such as the tanks described in French patent application No. 77. 02213 filed on Jan. 19, 1977 by the present applicants and the structure of which is recalled in FIG. 5, with a central input member on each side.

The fraction of current which supplies the upstream end A can conveniently be referred to as $\alpha$ and the fraction of current which supplies the downstream end B or the side input members, depending on the particular tank structure (FIGS. 5 and 6) can be referred to as $(1-\alpha)$.

We shall now determine the position of the negative conductors, in dependence on the parameter $\alpha$.

So as to simplify the calculations involved, we shall seek to determine the constant strength, in a conductor, which, disposed at the position of the cross member on the one hand and each negative collector on the other hand, would produce the same magnetic field as them. We then find to so-called equivalent strengths which appear in Table I below, which are valid only for points disposed in the median plane yOz.

TABLE I

| equivalent strength in: | tanks with central input members (Figure 5) | conventional tanks (Figure 6) |
|---|---|---|
| | αI in end A (1-α) in central input members | αI in end A (1-α) I in end B |
| cross member | 0.5αI | (α-0.5) I |
| negative collector | (0.5-0.25α) I | (0.75-0.5α) I |

(A) CASE OF A SERIES COMPRISING A SINGLE ROW OR TWO ROWS WHICH ARE SUFFICIENTLY SPACED FOR THERE NOT TO BE ANY MAGNETIC INTERACTION BETWEEN THE ROWS

Case 1: tanks supplied by way of an end and central input members (FIG. 5)

(1) Realisation of the condition $B_{yo}=0$ $B_{yo}$ due to the cross member:

$$\frac{2\times 0.5\alpha I\cdot k_1}{h}=\frac{\alpha I\cdot k_1}{h}$$

in which $k_1$ is an experimental coefficient which takes account of the fact that in practice the cross member is formed by two arms and the discontinuity due to the space between the cross-members of each tank in a row. The coefficient $k_1$ is almost always close to 0.9, and we shall retain this value hereinafter;

h is the height of the cross member above the reference plane xOy;

$b_{yo}$ due to the negative collector $1=b_{yo}$ due to the negative collector 2=

$$\frac{2(0.5-0.25\alpha)\,I}{\sqrt{Y^2+Z^2}}\times\frac{Z}{\sqrt{Y^2+Z^2}}=\frac{(1-0.5\alpha)\,I\cdot Z}{Y^2+Z^2}$$

$B_{yo}$ is equal to: $b_{yo}$ (cross member)$+b_{yo}$ (collector 1)$+b_{yo}$ (collector 2) and must be equal to 0. Hence:

$$\frac{(1-0.5\alpha)\,I\cdot Z}{Y^2+Z^2}+\frac{0.9\alpha\,I}{2h}=0$$

from which we have:

$$Y^2+Z^2=\frac{(1-0.5\alpha)\cdot 2h}{0.9\alpha}\,Z$$

By making:

$$\mu=\frac{(1-0.5\alpha)\,2h}{0.9\alpha} \qquad (1)$$

we have:

$$Y^2+Z^2+\mu Z=0 \qquad (2)$$

(2) Realisation of the condition $B_z(M)=0$ $b_z(M)$ due to the cross member=

$$\frac{2.0.5\alpha\cdot I\cdot k_1}{\sqrt{a^2+h^2}}\times\frac{a}{\sqrt{a^2+h^2}}=\frac{0.9\alpha\cdot I\cdot a}{a^2+h^2}$$

$b_z(M)$ due to the collector 1:

$$\frac{-2(0.5-0.25)I}{\sqrt{(Y-a)^2+Z^2}}\times\frac{Y-a}{\sqrt{(Y-a)^2+Z^2}}=\frac{-(1-0.5\alpha)\,I\,(Y-a)}{(Y-a)^2+Z^2}$$

$b_z(M)$ due to the collector 2:

$$\frac{2(0.5-0.25)I}{(Y-a)^2+Z^2}\times\frac{Y+a}{(Y+a)^2+Z^2}=\frac{(1-0.5\alpha)\,I\,(Y+a)}{(Y+a)^2+Z^2}$$

The condition $B_z(M)=0$ is written as follows: $b_z$ (M) cross member+$b_z$ (M) collector 1+$b_z$ (M) collector 2=0 that is to say:

$$I(1-0.5)\left[-\frac{Y-a}{(Y-a)^2+Z^2}+\frac{Y+a}{(Y+a)^2+Z^2}\right]=\frac{0.9\alpha\,I\,a}{a^2+h^2}$$

or by effecting:

$$\frac{Z^2-Y^2+a^2}{(Z^2+Y^2-a^2)^2+4a^2Z^2}=\frac{-0.9\alpha}{2(a^2+h^2)(1-0.5\alpha)} \quad (3)$$

It will be noted that I has disappeared, which proves that the solution will be independent of the current strength passing through the tank.

$$\text{By making } \gamma=\frac{-0.9\alpha}{(a^2+h^2)(1-0.5\alpha)} \quad (4)$$

$$\text{we also have: } \gamma=\frac{Z^2-Y^2+a^2}{(Z^2+Y^2-a^2)^2+4a^2Z^2}$$

Using the value of $y^2$ drawn from equation (2), we obtain the second degree equation: in respect of Z:

$$(\mu^2\gamma+4a^2\gamma-2)\,Z^2-\mu\,(1-2a^2\gamma)\,Z+a^2(\gamma a^2-1)=0 \quad (5)$$

which makes it possible to obtain the value of Z which is put into equation (2) to obtain the value of Y.

(3) Realisation of the condition: $dB_{yo}/dz=0$

We have: $B_{yo}$ due to the cross member:

$$\frac{\alpha I k_1}{h}=\frac{0.9\,\alpha\,I}{h}$$

$$\frac{dB_{y^o}}{dz}=\frac{0.9\,\alpha\,I}{h^2}$$

$b_{yo}$ due to the negative collectors:

$$b_{y^o}=2\times2\times(0.5-0.25\alpha)\,I\cdot\frac{Z}{Z^2+Y^2}-\frac{Z-dZ}{(Z-dZ)^2+Y^2}=(2-\alpha)\,I\times\frac{dz(Y^2-Z^2)}{(Y^2-Z^2)^2}$$

we must have: $db_y$ (cross member)+2 $db_y$ (collectors)=0

$$\text{that is: } \frac{0.9\,\alpha\,I}{h^2}-(2-\alpha)I\frac{(Y^2-Z^2)}{(Y^2+Z^2)^2}=0$$

$$\text{or: } \frac{Y^2-Z^2}{(Y^2+Z^2)^2}=\frac{0.9\alpha}{(2-\alpha)h^2}$$

$$\text{By making, as above, } \mu=\frac{(2-\alpha)h}{0.9\alpha}$$

The condition is written as follows:

$$\frac{Y^2-Z^2}{(Y^2+Z^2)^2}=\frac{1}{h\mu}$$

It will be seen that:

(1) $\mu$ and $\gamma$ are functions of the parameter $\alpha$, defined above. We therefore obtain the solutions, that is to say, the values of Z and Y, in the form of a curve which is the geometric locus of the position of the negative conductors, which carry into effect the conditions set out at the outset.

(2) Equations (5) and (6) are independent of the current strength, insofar as a and h which are involved in $\mu$ and $\gamma$ are constant. In fact, 'h', being the height of the cross member, does not depend on the size of the tanks and 'a' being half the width of the anodic system, may not vary if the size of the tanks is increased by simply elongating the anodic system along Ox. In practice 'a' varies relatively little and is for example 1.20 meters for a 100,000 ampere tank and 1.50 meters for a 200,000 ampere tank. Above this, for technological reasons, 'a' is no longer increased.

PRACTICAL EMBODIMENTS

EXAMPLE 1

The results set out above were applied to a series of 100,000 ampere tanks, with central riser input members, in which h (height of the cross member above the plane xOy) is 1.77 m and a (half the width of the anodic system) is 1.175, the tanks also comprising on each large side, 11 cathodic output bars. Under these conditions, $\alpha$ can therefore vary only by the fraction 1.11. However, it is also possible to envisage continuous variations in the value of $\alpha$, by adjusting the electrical resistance of the connecting conductors.

Six values of $\alpha$ were considered: 2/11 (0.182), 3/11 (0.273), 4/11 (0.364), 5/11 (0.455), 6/11 (0.545) and 7/11 (0.636).

Application of formulae 1 to 5 gives the following results:

TABLE 2

| | dimension ± Y in m | dimension Z in m |
|---|---|---|
| 0.182 | 6.00 | −2.04 |
| 0.273 | 4.38 | −1.80 |
| 0.364 | 3.38 | −1.57 |
| 0.455 | 2.68 | −1.35 |
| 0.546 | 2.14 | −1.11 |
| 0.636 | 1.66 | −0.81 |

N.B.: The sign ± means that this dimension is valid in respect of negative conductors disposed on each side of the tank.

Figure 7:
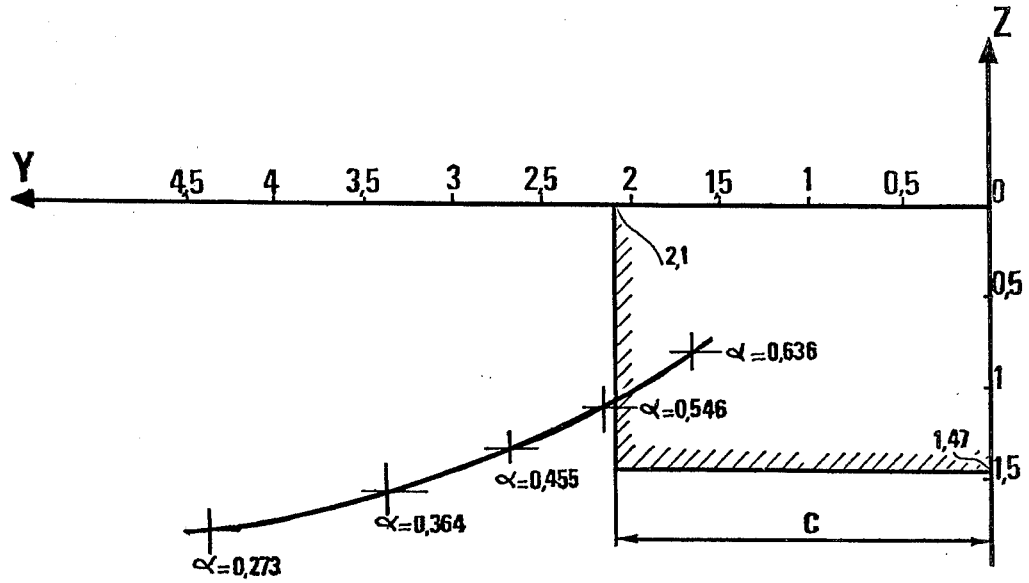
Figure 8:
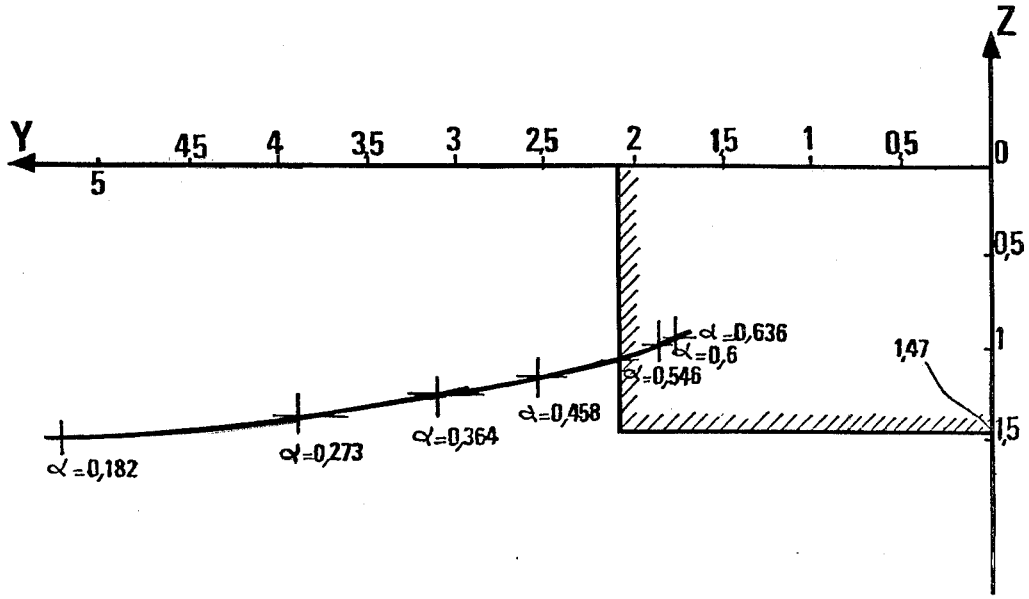

These values have been entered in the graph in FIG. 7 which is in fact a transverse half section of a lengthwise tank, passing through the central point 0. The lines which are bordered by hatched areas indicate the external dimensions of the body of the tank.

It will be noted that, for values of $\alpha$ of more than 0.55, the conductors should be disposed within the tank. For considerations of economy and size, $\alpha$ can therefore be from 0.35 to 0.55.

We shall now seek simultaneously to carry into effect:

(1) The conditions: $dB_{yo}/dz=0$ and $B_{yo}=0$ (2) The conditions: $B_z(M)=0$ and $B_{yo}=0$ and see if the solutions are compatible with each other, at least approximately, and if the three conditions can be achieved simultaneously:

Condition $B_{yo}=0$ implies:

$$Z^2+Y^2+\mu Z=0 \text{ or } Y^2=-\mu Z-Z^2 \quad (6A)$$

By putting the value of $Y^2$ in (6) it becomes:

$$\frac{-\mu Z - Z^2 - Z^2}{(-\mu Z)^2} = \frac{1}{\mu h}$$

that is to say, on resolving the equation:

$$Z = \frac{-\mu h}{\mu + 2h} \quad (7)$$

By introducing this value of Z into equation (6A), we find Y.

It is therefore possible to trace on a graph the curves $(Y, Z) = f(\alpha)$ which satisfy on the one hand $dB_{yo}/dz = 0$ and $B_{yo}$ and on the other hand $B_z(M) = 0$ and $B_{yo} = 0$ and see if their intersection, for the position of the conductor, gives an acceptable value.

EXAMPLE 2

We seek to realise simultaneously the following three conditions:

$$dB_{yo}/dz = 0,\ B_{yo} = 0,\ B_z(M) = 0$$

We add to Table I, to facilitate tracing the curve, Y, $Z = f(\alpha)$ satisfying $B_z(M) = 0$ and $B_{yo} \neq 0$, a value of $\alpha = 0.6$, which gives $Y = 1.86$ and $Z = -0.98$.

We then trace the curve Y, $Z = f(\alpha)$, which satisfies the two equations $dB_{yo}/dz = 0$ and $B_{yo} = 0$. We find:

TABLE 3

| α | ±Y | Z |
|---|---|---|
| 0.182 | 5.22 | −1.49 |
| 0.273 | 3.91 | −1.38 |
| 0.364 | 3.10 | −1.26 |
| 0.456 | 2.53 | −1.16 |
| 0.546 | 2.10 | −1.06 |
| 0.6 | 1.86 | −1.98 |
| 0.636 | 1.77 | −0.96 |

It will be seen that the two curves intersect at a point having co-ordinates $Y = 1.96$ and $Z = -1.01$.

This point corresponds to a position of the conductor within the tank body, but in practice, it is possible to use an adjacent point, outside of the tank; as the two curves move apart only gradually, this solution still remains acceptable.

EXAMPLE 3

The same results were applied to a 200,000 ampere tank in which $h = 1.77$ m and $a = 1.50$ m, the tank also having 11 cathodic bars on each long side. We have the following values:

TABLE 4

| α | ±Y | Z |
|---|---|---|
| 0.182 | 6.36 | −2.34 |
| 0.273 | 4.58 | −2.01 |
| 0.364 | 3.48 | −1.70 |
| 0.455 | 2.69 | −1.36 |
| 0.546 | 1.99 | −0.91 |

In the graph in FIG. 9, it will be seen that the curves of Y, $Z = f(\alpha)$ are very close for 100,000 amperes and 200,000 amperes, but that the value $\alpha = 0.546$ results in a geometrical impossibility.

The two curves would moreover be in a position of coincidence if the increase in strength had been obtained simply by elongating the cathode. In actual fact, the anodes were also enlarged (factor 'a'). Otherwise, a and h being constant, the same would apply for $\mu$ and $\gamma$, and the equation (5) being independent of strength, the curves Y, $Z = f(\alpha)$ would be identical.

Case 2: conventional tanks (FIG. 6) supplied by way of the two ends of the cross member. No adjacent row. The end A (upstream) receives a strength $\alpha I$, and the end B (downstream) receives $(1-\alpha)I$.

The calculation is identical, but the equivalent strengths (see Table I) of the cross member and the negative connectors being different, the new values of $\mu, \gamma$ are as follows:

$$\mu' = \frac{(1.5 - \alpha)2H}{k_1(2\alpha - 1)} \text{ or,} \quad (8)$$

$$\text{with } k_1 = 0.9;\ \mu' = \frac{(1.5 - \alpha)2h}{0.9(2\alpha - 1)}$$

$$\gamma' = \frac{-(2\alpha - 1)k_1}{2(a^2 + h^2)(1.5 - \alpha)} \text{ or,} \quad (9)$$

$$\text{with } k_1 = 0.9;\ \gamma' = \frac{-0.9(2\alpha - 1)}{2(a^2 + h^2)(1.5 - \alpha)}$$

Equations (10) and (11) are therefore identical to (2) and (5), namely:

$$Y^2 + Z^2 + \mu' Z = 0 \quad (10)$$

$$(\mu'^2\gamma' + 4a^2\gamma' - 2)Z^2 - \mu'(1 - 2a^2\gamma')Z + a^2(\gamma' a^2 - 1) = 0$$

EXAMPLE 4

In dependence on the foregoing result, we determined the position of the negative conductors for a conventional 100,000 ampere tank, with a cross member supplied by way of the two ends with $h = 1.77$ m and $a = 1.175$ m, and also comprising 11 cathodic output bars on each long side.

TABLE 5

| α | dimension ± in m | dimension Z in m |
|---|---|---|
| 6/11 = 0.546 | 9.44 | −2.29 |
| 7/11 = 0.636 | 4.38 | −1.80 |
| 0.7 | 3.07 | −1.48 |
| 8/11 = 0.725 | 2.68 | −1.34 |
| 0.8 | 1.86 | −0.95 |
| 9/11 = 0.818 | 1.66 | −0.81 |

These values are shown in the graph in FIG. 10; it will be seen that $\alpha = 0.8$ results in an impossibility and that, for reasons of economy, $\alpha$ should be from 0.65 to 0.75.

(B) Case of a series comprising two adjacent rows in the same building

In practice, the economic situation is to install the two rows of tanks in the same building. This then introduces a vertical field due to the adjacent row, which is fairly uniform in value and which is of the same sign. If the vertical field of the tank with its row is denoted by $b_z$ (tank) and the vertical field induced by the adjacent row is denoted by $b_z$ (adjacent row), it will be seen from the graph in FIG. 11 that it is possible simultaneously to achieve:

$B_z(M) = b_z(M)$ (tank) $+ b_z(M)$ (adjacent row) $= 0$ and $B_z(N) = b_z(N)$ (tank) $+ b_z(N)$ (adjacent row) $= 0$ as $b_z(M)$ (tank) $= -b_z(N)$ (tank), since $b_z$ is anti-symmetric with respect to Oy, while $b_z(M)$ (adjacent row) is substantially equal to $b_z(N)$ (adjacent row) and of the same sign.

In FIG. 11, the curve 1 represents the variation in $b_z$ (tank) without adjacent row, along M.O.N. the curve 2 represents the variation in $b_z$ (adjacent row) along M.O.N., and the curve 3 represents the variation in $B_z$ (tank+adjacent row) along M.O.N.

The effect of the adjacent row must therefore be compensated.

For that purpose, a certain number of solutions have already been previously proposed, for example the solutions which form the subjects of French Pat. Nos. 1 079 131 filed Apr. 7, 1953 (Compagnie PECHINEY) which proposes creating an electrical loop around the tank, 1 185 548 filed on Oct. 29, 1957 (Elektrokemisk A.S.) which provides for a dissymmetric supply to the ends A and B, just as in French Pat. No. 1 586 867 filed on June 28, 1968 (Vsesojuzny Nauchnoissledovatelsky i Proektny Institut Aluminievoi) or in French Pat. No. 2 333 060 filed on Nov. 28, 1975 (Aluminium Pechiney) which proposes differential positioning of the negative collectors on each side of the tank.

The last two solutions substantially reduce the adjacent row effect, but not uniformly over the whole of the tank. In addition, $b_y$ (tank), and $b_z$ (tank) are no longer anti-symmetric with respect to Ox. This accordingly creates a dssymmetry in respect of the Laplace forces in $F_y l$.

The method which we shall now describe uses a compensation conductor through which passes a current -i which circulates in the opposite direction to the current I of the series, being disposed on the outward side of the two rows of tanks, and being placed at a minimum distance from the tank body, which is compatible with electrical safety.

A similar method has already been described in U.S. Pat. No. 3,616,317. However, it is appropriate for it to be made compatible with the conditions set out hereinbefore, and in particular with achieving $B_{yo}=0$ and $B_z$ (M)=0. FIG. 12 is a view in diagrammatic section of an electrolysis hall 1 comprising two adjacent rows of which only the anodic systems 2 and 3 are shown and in which the tanks are disposed lengthwise. The compensation conductors are at 4 and 5. The conductors connecting between the tanks are omitted, for the sake of simplicity of the drawing. The curved arrows diagrammatically show the directions of the magnetic field generated by each compensation conductor.

The following symbols are used:

a: half the width of the anodic system d: the distance of the compensation conductor from the outer edge of the anode l: the distance between the internal edges of the anodic systems of the two rows of tanks E: the field produced by the compensation conductor in M (inward side)

F: the field produced by the compensation conductor in N (outward side)

e: the field of the adjacent row in M f: the field of the adjacent row in N m: the field $b_z$ of the tank without any adjacent row effect.

Taking account of the two compensation conductors, we have:

$$E = -2\,i\,\frac{2d + 4a + l}{d^2 + d(4a + l) + 4a^2 + 2al} \quad (12a)$$

$$E = -2\,i\,\frac{2d + 4a + l)}{d^2 + d(4a + l)} \quad (12b)$$

From these we deduce a ratio K:

$$K = \frac{E}{F} = \frac{d^2 + d(4a + l)}{d^2 + d(4a + l) + 4a^2 + 2al} \quad (12c)$$

in which l and d are values fixed at the time of construction and virtually independent of the size of the tanks; K varies with 'a' but only slightly, as shown by equation (12c).

For a series of tanks in which the distance between anodes l=7.40 m and in which the distance between the compensation conductor and the outer edge of the anode d=1.80 m, we find:

for a 100,000 ampere tank, in which a=1.175, identical to that of Examples 1 and 3: K+0.52; for a 200,000 ampere tank, in which a=1.5, identical to that of Example 2: K=0.47.

We may therefore base ourselves on a value of K=0.5.

We shall now choose a basic tank structure in respect of which the value of the vertical field $b_z$ (without adjacent row) is m at point M, and therefore -m at point N. M is determined by the following equations:

$$-m+e+KF=0$$

$$-m+f+F=0$$

hence the values:

$$m = \frac{Kf - e}{1 + k} \quad (13a)$$

$$F = -\frac{(e + f)}{1 + k} \quad (13b)$$

$$E = -\frac{(e + f)K}{1 + k} \quad (13c)$$

e and f are directly proportional to i, and the values of m, E and F will therefore also be proportional to i. It is therefore possible to define three characteristics:

$$m'=M/I$$

$$F'=F/I$$

$$E'=E/I$$

which are valid for all the tanks disposed lengthwise, taking I for convenience as expressed in kilo-amperes.

K being close to 0.5, the equations can in practice be written as follows:

$$m = \frac{0.5\,f - e}{1.5}$$

$$F = \frac{(e + f)}{1.5}$$

$$E = \frac{(e + f)}{3}$$

PRACTICAL USES

EXAMPLE 5

For a series of 100,000 ampere tanks, identical to those of Examples 1 and 2, the values of the vertical field due to the adjacent row in M and N, with l=7.40 m and d=1.80 m, are respectively (measured values):

$e=24.4\times10^{-4}$ Tesla $f=18.9\times10^{-4}$ Tesla we have:

K=0.522—according to equation (12c)

$m' = -0.0955 \times 10^{-4}$ T/1000 A—according to equation (13a)

$F' = -0.284 \times 10^{-4}$ T/1000 A—according to equation (13b)

$E' = -0.149 \times 10^{-4}$ T/1000 A—according to equation (13c)

Hence i', the strength of current in the compensation conductor, according to equation (12a) or (12b)=226 A/1000 A that is, 22.6% of I.

It is verified that at points M and N, we do in fact have: $B_z(M) = B_z(N) = 0$ $$\text{In } M = -9.6 \times 10^{-4}\,T - 15 \times 10^{-4}\,T + 24.4 \times 10^{-4}\,T = 0$$

$$\text{In } N = +9.6 \times 10^{-4}\,T - 28.4 \times 10^{-4}\,T + 18.9 \times 10^{-4}\,T = 0$$

EXAMPLE 6

Using the same tanks as in Examples 1 and 3, the distance d was reduced to 1.20 m (this reduction is possible only if the arrangement of the tanks permits). This results in a substantial reduction in the current strength i in the compensation conductor.

We have:

K=0.41

$m' = -0.1184 \times 10^{-4}$ T/1000 A $F' = -0.307 \times 10^{-4}$ T/1000 A $E' = -0.126 \times 10^{-4}$ T/1000 A i'=169 A/1000 A ie 16.9%

We verify that at points M and N we do in fact have $B_z(M) = B_z(N) = 0$ $$\text{In } M = -11.8 - 12.6 + 24.4 = 0$$

$$\text{In } N = +11.8 - 30.7 + 18.9 = 0$$

In conclusion:

If we produce a tank in which the field m' per 100,000 amperes at point M is equal to $$m = \frac{0.5\,f - e}{1.5 \cdot I(ka)}$$

in $10^{-4}$ T, the total field $B_z$ obtained will be zero, using a compensation conductor through which passes a current i which will be dependent on its distance from the outer edge of the anode.

When an old series of tanks is converted, for reasons of electrical safety and space occupied, d will be close to 1.80 m and the current strength i in the compensation conductor will in this case be 22.6% of the current I of the series.

In the case of a new series, d can be smaller, because it will be disposed in an independent duct isolated from the series. For d=1.20, the compensation current will be only 16.9% of the current I.

This method therefore makes it possible to minimise the investment cost, and the consumption of the compensation conductor.

This compensation method will now be combined with the method described above, seeking to make $B_z$ (M) and $B_y$ (o) zero.

Case 3: Tanks with central riser input member (FIG. 5); supply to the cross member by the end A at a current strength $\alpha i$, by the central input members at a strength $(1-\alpha)I$. The adjacent row is taken into account.

In this case, the condition $B_{yo}=0$ does not change as, the adjacent row and the compensation conductor being substantially in the plane of the metal, they do not have any action on $B_y$. We therefore have the same equations as (2) and (5) in case 1.

$$Z^2 + Y^2 + \mu z = 0 \tag{14}$$

$$\text{with } \mu_1 = \mu = \frac{(1-0.5\alpha)2h}{k_1} \text{ where } = \frac{(1-0.5\alpha)2h}{0.9\alpha} \tag{15}$$

In contrast, the condition $B_z$ (M) is modified:

We have:

$b_z$ (M) cross member + $b_z$ (M) collector 1 + $b_z$ (M) collector 2 = m

Employing the same calculation as in case 1, we find:

$$\frac{Z^2 - Y^2 + a^2}{(Z^2 + Y^2 + a^2)^2 + 4a^2Z^2} = \frac{m' - \dfrac{k_1 a}{a^2 + h^2}}{(1 - 0.5\alpha)} \times \frac{1}{2a}$$

by stating:

$$\gamma_1 = \frac{m' - \dfrac{k_1 a}{(a^2 + h^2)}}{(1 - 0.5\alpha)2a} \text{ i.e with } k_1 = 0.9;\ \frac{m' - \dfrac{0.9\alpha \cdot a}{(a^2 + h^2)}}{(1 - 0.5\alpha)2a}$$

we have:

$$\frac{Z^2 - Y^2 + a^2}{(Z^2 + Y^2 + a^2)^2 + 4a^2Z^2} = \gamma_1$$

Taking the value of $Y^2$ from equation (14), we obtain the second degree equation:

$$(\mu^2{}_1\gamma_1 + 4a^2\gamma_1 - 2)\,Z^2 - \mu_1(1 - 2a^2\gamma_1)\,Z + a^2(\gamma_1 a^2 - 1) = 0 \tag{16}$$

this equation is identical to equation (5) of case 1, without adjacent row, with a fresh coefficient $\gamma_1$. It makes it possible to calculate Z which is put into equation (14) to obtain Y.

EXAMPLE 7

100,000 Ampere tanks are considered, which are identical to those of Examples 1 and 3 and which are arranged in two rows per building, with a distance between anodes l=7.40 m and a compensation conductor which is disposed at a distance d=1.80 m, as in Example 4.

Calculations are effected in the same manner, and with the same conventions, for $\alpha$:

TABLE 6

| $\alpha$ | ±Y in m | Z in m |
|---|---|---|
| 0.182 | 3.83 | −0.78 |
| 0.273 | 3.26 | −0.92 |
| 0.364 | 2.76 | −0.96 |
| 0.455 | 2.31 | −0.92 |
| 0.546 | 1.90 | −0.81 |

In FIG. 13, the broken-line curve 1 corresponds to the solution of case 1, the solid-line curve 2 corresponds to the solution which takes account of the adjacent row. It is found that, for practical and economic reasons, $\alpha$ will be from 0.35 to 0.50.

EXAMPLE 8

200,000 Ampere tanks are considered, which are identical to those of Examples 1 and 3 but which are disposed in two rows per building, with a distance between anodes l=7.40 m and a compensation conductor which is disposed at a distance of 1.80 m, as in Example 5.

In the same manner, we obtain the values of y and z which are entered in the graph in FIG. 14.

TABLE 7

| α | ±Y | Z |
|---|---|---|
| 0.091 | 5.01 | −0.62 |
| 0.182 | 4.24 | −0.92 |
| 0.273 | 3.54 | −1.10 |
| 0.364 | 2.92 | −1.10 |
| 0.455 | 2.35 | −0.96 |

Case 4: conventional tanks (FIG. 6) comprising a cross member with supply by the upstream end (A) at a current strength αI and by the downstream end (B) at a current strength (I−α)I.

Account is taken of the adjacent row.

The calculation is identical to that of case 1, but the equivalent strengths of the cross member and the negative collectors being different, we will have fresh values for the coefficients μ and γ.

Realisation of the condition $B_y(o)=0$ $$\mu'_1 = \frac{(1.5-\alpha)2h}{k_1(2\alpha-1)} \text{ or } \frac{(1.5-\alpha)2h}{0.9(2\alpha-1)} \quad (17)$$

By not being influenced by the adjacent row, nor by the compensation conductor in plane xOy, of the metal, we have:

$$Y^2+Z^2+\mu'_1 Z=0 \quad (9)$$

Realisation of the condition $B_z(M)=0$

The fresh value of $\gamma'_1$ is:

$$\gamma'_1 = \frac{m' - \dfrac{(2\alpha-1)k_1 a}{a^2+h^2}}{\therefore(1.5-\alpha)2a} \text{ i.e (with } k_1 = 0.9\text{):} \quad \frac{m' - \dfrac{0.9(2\alpha-1)a}{a^2+h^2}}{(1.5-\alpha)2a}$$

The equation (19) giving z is the same as (16), with the fresh values of $\mu'_1$ and $\gamma'_1$:

$$(\mu'_1\gamma'^2_1+4a^2\gamma'_1-2)\,Z^2-\mu'_1(1-2a^2\gamma'_1)\,Z+a^2(\gamma'_1a^2-1)=0 \quad (19)$$

EXAMPLE 9

100,000 Ampere conventional tanks (FIG. 6) are considered, which are identical to those of Example 4, being placed in two rows in the same building, with a distance between anodes l=7.40 m and a compensation conductor disposed at a distance d=1.80 m (as in Example 5).

The values of Y and Z are obtained in the same manner as in the previous cases:

TABLE 8

| α | ±Y | Z |
|---|---|---|
| 0.546 | 4.50 | −0.50 |
| 0.636 | 3.33 | −0.97 |
| 0.727 | 2.36 | −0.97 |

which are entered in the graph in FIG. 15.

CONCLUSION

It will be seen from these different examples, taking account of the practical and economic considerations which result in the conductors not being laid at an excessive distance from the tank, nor being in direct contact therewith, that, for the purposes of performing the invention, the current distribution coefficient α will be made equal to or less than 0.55 in the case of tanks which are supplied by way of an end and at least one central riser input member on each side, and preferably from 0.45 to 0.55, and equal to or less than 0.75 in the case of conventional tanks which are supplied by way of both ends, and preferably from 0.75 to 0.65.

We claim:

1. A process for reducing magnetic disturbances in series of electrolysis tanks, operating at high current strength, for the production of aluminium, the tanks being disposed lengthwise, each tank being supplied with current from the preceding tank both by way of the upstream end at a fraction α of the current strength, and by way of at least one other point disposed between the upstream end and the downstream end inclusive, with a fraction (1−α) of the current strength, characterised in that the horizontal longitudinal component $B_y$ of the magnetic field at the centre of the tank is nullified and that the vertical component $B_z$ of the magnetic field is made anti-symmetric with respect to the axis Oy by disposing the negative conductors in such a way that they are parallel to the axis Ox and pass substantially through the points of co-ordinates Y and Z satisfying the two following relationships:

$$Y^2+Z^2+\mu Z=0$$

$$(\mu^2\gamma+4a^2\gamma-2)\,Z^2-\mu(1-2a^2\gamma)\,Z+a^2(\gamma a^2-1)=0$$

in which μ and γ are coefficients which are independent of strength and which depend solely on the half-width 'a' of the anodic system, the height 'h' of the cross member above the cathodic reference plane xOy, and the fraction α of the current strength which supplies the upstream end of each tank.

2. A process for reducing magnetic disturbances in series of electrolysis tanks operating at high current strength, in accordance with claim 1, characterised in that the vertical gradient of the horizontal component of the magnetic field at the centre of the tank $dB_{yo}/dz$ is nullified, by determining the co-ordinates Y and Z of the negative conductors in such a way that they at least approximately satisfy a third relationship:

$$\frac{Y^2-Z^2}{(Y^2+z^2)^2} = \frac{1}{\mu h}$$

3. A process for reducing magnetic disturbances in series of electrolysis tanks operating at a high current strength, in accordance with claims 1 or 2 characterised in that, for a tank which is supplied with current by way of the two ends, the upstream end receiving a fraction α of the total current, the coefficients $\mu$ and $\gamma$ which makes it possible to fix the position of the negative conductors are determined by the relationships:

$$\mu = \frac{(1.5 - \alpha)2h}{0.9(2\alpha - 1)}$$

$$\gamma = \frac{-0.9(2\alpha - 1)}{2(a^2 + h^2)(1.5\alpha)}$$

4. A process for reducing magnetic disturbances in series of electrolysis tanks operating at a high current strength in accordance with claims 1 or 2 characterised in that, for a tank which is supplied with current by way of the upstream end and at least one central riser input member, on each side, the upstream end receiving a fraction $\alpha$ of the total current, the coefficients $\mu$ and $\gamma$ which make it possible to fix the position of the negative conductors are determined by the relationships:

$$= \frac{(1 - 0.5\alpha)2h}{0.9\alpha}$$

$$= \frac{-0.9\alpha}{2(a^2 + h^2)(1 - 1.5\alpha)}$$

5. A process for reducing magnetic disturbances in series of electrolysis tanks operating at a high current strength according to one of the preceding claims characterised in that the current distribution coefficient $\alpha$ is made:

equal to or lower than 0.55 and preferably from 0.45 to 0.55 in the case of tanks which are supplied by way of the upstream end and at least one central riser input member on each side, equal to or lower than 0.75 and preferably from 0.75 to 0.65 in the case of conventional tanks which are supplied by way of the two ends.

* * * * *

UNITED STATES PATENT OFFICE

CERTIFICATE OF CORRECTION

Patent No. 4,210,514 Dated July 1, 1980

Inventor(s) Paul Morel and Jean-Pierre Dugois

It is certified that error appears in the above-identified patent and that said Letters Patent are hereby corrected as shown below:

Col. 11, line 26, cancel "$F_y1$" and substitute -- $F_y$ --

Col. 13, line 45, delete " m = "

Signed and Sealed this

*Twenty-eighth* Day of *October 1980*

[SEAL]

*Attest:*

SIDNEY A. DIAMOND

*Attesting Officer*

*Commissioner of Patents and Trademarks*